US011330358B2

(12) United States Patent
Ganeshkumar

(10) Patent No.: US 11,330,358 B2
(45) Date of Patent: May 10, 2022

(54) WEARABLE AUDIO DEVICE WITH INNER MICROPHONE ADAPTIVE NOISE REDUCTION

(71) Applicant: Bose Corporation, Framingham, MA (US)

(72) Inventor: Alaganandan Ganeshkumar, North Attleboro, MA (US)

(73) Assignee: BOSE CORPORATION, Framingham, MA (US)

( * ) Notice: Subject to any disclaimer, the term of this patent is extended or adjusted under 35 U.S.C. 154(b) by 11 days.

(21) Appl. No.: 16/999,353

(22) Filed: Aug. 21, 2020

(65) Prior Publication Data

US 2022/0060812 A1 Feb. 24, 2022

(51) Int. Cl.
*H04R 1/10* (2006.01)
*G10K 11/178* (2006.01)

(52) U.S. Cl.
CPC ..... *H04R 1/1083* (2013.01); *G10K 11/17815* (2018.01); *G10K 11/17873* (2018.01); *G10K 11/17875* (2018.01); *G10K 2210/1081* (2013.01); *G10K 2210/3026* (2013.01); *G10K 2210/3027* (2013.01)

(58) Field of Classification Search
CPC ..... H04R 1/1083; H04R 1/1016; G10K 11/17873; G10K 11/17875; G10K 11/17815; G10K 2210/1081; G10K 2210/3026; G10K 2210/3027
See application file for complete search history.

(56) References Cited

U.S. PATENT DOCUMENTS

| | | | | |
|---|---|---|---|---|
| 10,079,026 | B1 * | 9/2018 | Ebenezer | H04R 25/43 |
| 2009/0016541 | A1 | 1/2009 | Goldstein et al. | |
| 2011/0007907 | A1 * | 1/2011 | Park | G10K 11/17881 381/71.8 |
| 2013/0101129 | A1 * | 4/2013 | Christoph | G10K 11/17817 381/71.1 |
| 2016/0267899 | A1 | 9/2016 | Gauger, Jr. et al. | |
| 2017/0148428 | A1 | 5/2017 | Thuy et al. | |
| 2019/0158672 | A1 | 5/2019 | McIntosh et al. | |
| 2020/0359144 | A1 * | 11/2020 | Holter | H04R 29/001 |
| 2021/0092233 | A1 * | 3/2021 | Hua | H04R 1/1016 |
| 2021/0304725 | A1 * | 9/2021 | Kannan | G10K 11/17854 |

OTHER PUBLICATIONS

PCT International Search Report and Written Opinion for International Application No. PCT/US2021/045488, dated Dec. 7, 2021, 14 pages.

* cited by examiner

*Primary Examiner* — Jason R Kurr
(74) *Attorney, Agent, or Firm* — Hoffman Warnick LLC

(57) ABSTRACT

Various implementations include systems for processing inner microphone audio signals. In particular implementations, a system includes an external microphone configured to be acoustically coupled to an environment outside an ear canal of a user; an inner microphone configured to be acoustically coupled to an environment inside the ear canal of the user; and an adaptive noise cancelation system configured to process an internal signal captured by the inner microphone and generate a noise reduced internal signal, wherein the noise reduced internal signal is adaptively generated in response to an external signal captured by the external microphone.

25 Claims, 6 Drawing Sheets

WEARABLE AUDIO DEVICE WITH INNER MICROPHONE ADAPTIVE NOISE REDUCTION

TECHNICAL FIELD

This disclosure generally relates to wearable audio devices. More particularly, the disclosure relates to wearable audio devices that enhance the user's speech signal by employing adaptive noise reduction on an inner microphone.

BACKGROUND

Wearable audio devices such as headphones commonly provide for two way communication, in which the device can both output audio and capture user speech signals. To capture speech, one or more microphones are generally located somewhere on the device. Depending on the form factor of the wearable audio device, different types and arrangements of microphones may be utilized. For example, in over-ear headphones, a boom microphone may be deployed that sits near the user's mouth. In other cases, such as with in-ear devices, microphones may be integrated within an earbud proximate the user's ear. Because the location of the microphone is farther away from the user's mouth with in-ear devices, accurately capturing user voice signals can be more technically challenging.

SUMMARY

All examples and features mentioned below can be combined in any technically possible way.

Systems and approaches are disclosed that adaptively enhance in internal microphone on a wearable audio device. Some implementations include an external microphone configured to be acoustically coupled to an environment outside an ear canal of a user; an inner microphone configured to be acoustically coupled to an environment inside the ear canal of the user; and an adaptive noise cancelation system configured to process an internal signal captured by the inner microphone and generate a noise reduced internal signal, wherein the noise reduced internal signal is adaptively generated in response to an external signal captured by the external microphone.

In additional particular implementations, a method for processing signals associated with a wearable audio device includes: capturing an external signal with an external microphone configured to be acoustically coupled to an environment outside an ear canal of a user; capturing an internal signal with an inner microphone configured to be acoustically coupled to an environment inside the ear canal of the user; and processing the internal signal captured by the inner microphone to generate a noise reduced internal signal, wherein the noise reduced internal signal is adaptively generated in response to the external signal captured by the external microphone.

Implementations may include one of the following features, or any combination thereof.

In some cases, an adaptive noise cancellation system is configured to generate the noise reduced internal signal by: inputting the external signal; continuously calculating a set of noise cancellation parameters in response to the external signal; establishing a current set of noise cancelation parameters in response to a detection of speech by the user; and utilizing the current set of noise cancellation parameters to process the internal signal.

In particular implementations, the adaptive noise cancelation system is further configured to: in response to a determination that the user is no longer speaking: cease utilization of the current set of noise cancellation parameters to process the internal signal; and continuously calculate the set of noise cancellation parameters in response to the external signal.

In some cases, the detection of speech is detected with a voice activity detector (VAD).

In certain aspects, the wearable audio device includes an accelerometer that generates an accelerometer signal, wherein the adaptive noise cancelation system is configured to mix the accelerometer signal with the noise reduced internal signal to enhance frequency responses above approximately 2.5 kilohertz (kHz) to approximately 3.0 kHz.

In some implementations, the set of noise cancellation parameters comprise a set of filter coefficients.

In various cases, the wearable audio device further includes: a second adaptive noise cancelation system configured to generate a noise reduced external signal by reducing noise in the external signal; and a mixer that selectively mixes the noise reduced external signal with the noise reduced internal signal to generate a mixed signal.

In certain cases, the mixer includes a voice activity detector (VAD) input that signals the user is speaking; and a noise detection input that signals a presence of environmental noise.

In some cases, the mixed signal primarily includes the noise reduced internal signal in response to a detection that the user is speaking and environmental noise is present.

In other cases, the mixed signal primarily includes the noise reduced external signal in response to a detection that no environmental noise is present.

In certain implementations, the wearable audio device includes an accelerometer that generates an accelerometer signal to the mixer, wherein the accelerometer signal is selectively mixed with the noise reduced internal signal to provide an enhanced response for frequencies above approximately 2.5 kilohertz (kHz) to approximately 3.0 kHz.

In some cases, the accelerometer signal is further utilized by the VAD to detect whether the user is speaking.

In particular implementations, the mixed signal is further processed using a short time spectral amplitude process.

In some implementations, the wearable audio device further includes an equalizer that processes the mixed signal based on equalizer settings that are determined in response to an amount of the noise reduced external signal and an amount of the noise reduced internal signal present in the mixed signal.

In certain cases, the wearable audio device further includes: a first equalizer configured to process the noise reduced external signal prior to input to the mixer; and a second equalizer configured to process the noise reduced internal signal prior to input to the mixer.

In certain implementations, in response to a detection that the user is speaking and the noise reduced external signal is unavailable due to a predetermined amount of environmental noise: optionally processing the noise reduced internal signal with a bandwidth extension signal extractor to generate high frequency components and mixing the high frequency components with the noise reduced internal signal.

In other cases, in response to a detection that the user is speaking and a predetermined amount of environmental noise is detected: processing an external microphone signal with a high pass filter to obtain high frequency components and mixing the high frequency components with the noise reduced internal signal to generate the mixed signal.

In other cases, the VAD compares a first output from an internal microphone VAD with a second output from an external microphone VAD to detect a failure condition.

In various implementations, the internal signal and external signal are processed according to a method that includes: outputting an audio signal based on the noise reduced external signal in response to no detection of speech by the user; continuously calculating a set of noise cancellation parameters based on the external signal; establishing a current set of noise cancellation parameters in response to a detection of speech by the user; utilizing the current set of noise cancellation parameters to process the internal signal to generate the noise reduced internal signal; supplying the noise reduced external signal and the noise reduced internal signal to the mixer; mixing the noise reduced external signal and the noise reduced internal signal, wherein the mixing is based on an amount of environmental noise detected; and outputting the audio signal based on the mixed signal.

In some cases, the method further includes: in response to a determination that the user is no longer speaking: ceasing utilization of the current set of noise cancellation parameters to process the internal signal; continuously calculating the set of noise cancellation parameters based on the external signal; and outputting the audio signal based on the noise reduced external signal.

Figure 1:
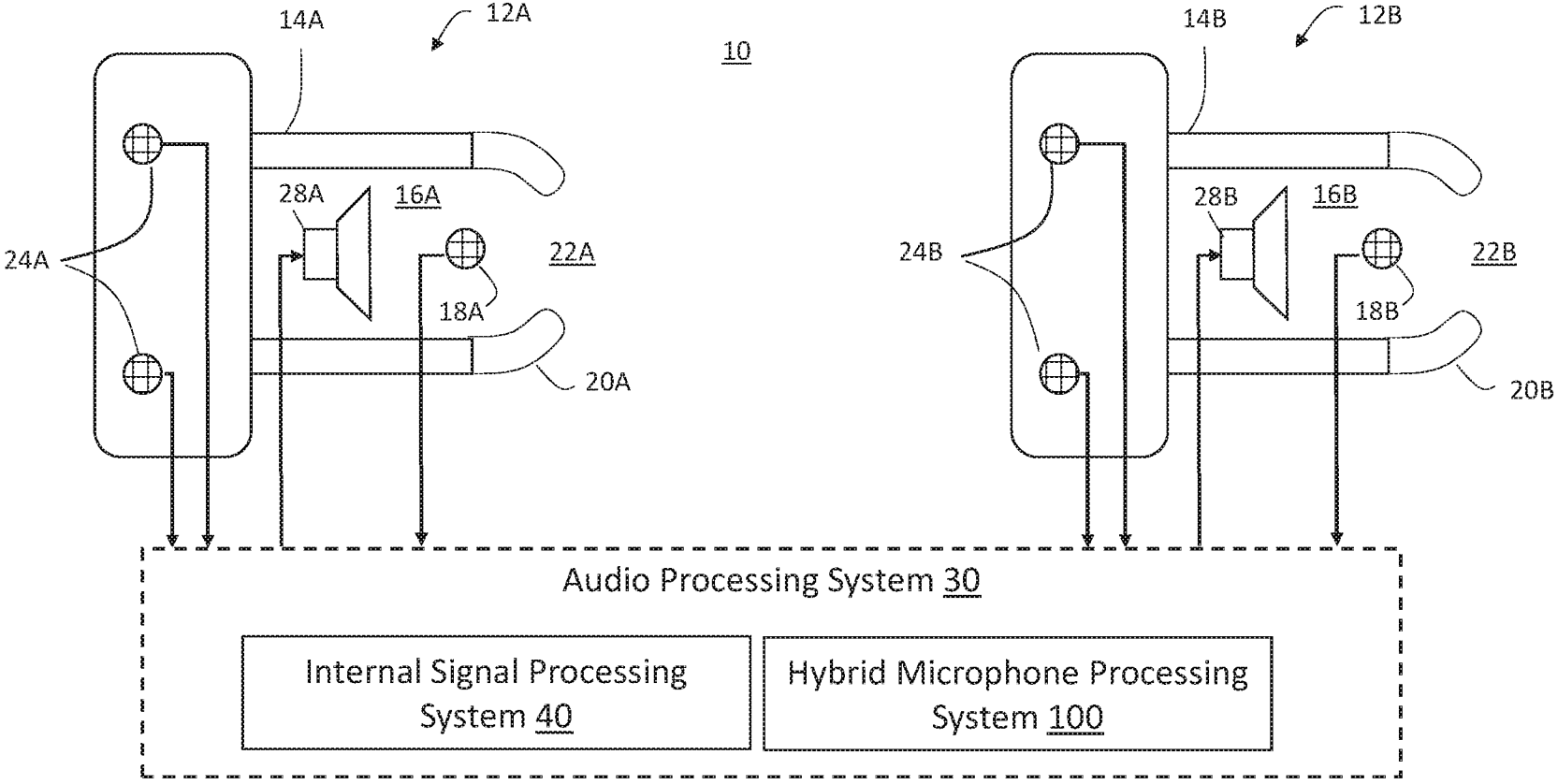
FIG. 1 is a block diagram depicting an example wearable audio device according to various disclosed implementations.

It is noted that the drawings of the various implementations are not necessarily to scale. The drawings are intended to depict only typical aspects of the disclosure, and therefore should not be considered as limiting the scope of the implementations. In the drawings, like numbering represents like elements between the drawings.

DETAILED DESCRIPTION

This disclosure is based, at least in part, on the realization that an internal signal captured from an inner microphone within a wearable audio device can be adaptively processed and utilized for communicating the user's voice when external environmental noise exists. Furthermore, the adaptive processing can be integrated into a hybrid system that selectively utilizes and/or mixes a processed internal signal with a processed external signal.

Aspects and implementations disclosed herein may be applicable to a wide variety of wearable audio devices in various form factors, but are generally directed to devices having at least one inner microphone that is substantially shielded from environmental noise (i.e., acoustically coupled to an environment inside the ear canal of the user) and at least one external microphone substantially exposed to environmental noise (i.e., acoustically coupled to an environment outside the ear canal of the user). Further, various implementations are directed to wearable audio devices that support two-way communications, and may for example include in-ear devices, over-ear devices, and near-ear devices. Form factors may include, e.g., earbuds, headphones, hearing assist devices, and wearables. Further configurations may include headphones with either one or two earpieces, over-the-head headphones, behind-the neck headphones, in-the-ear or behind-the-ear hearing aids, wireless headsets (i.e., earsets), audio eyeglasses, single earphones or pairs of earphones, as well as hats, helmets, clothing or any other physical configuration incorporating one or two earpieces to enable audio communications and/or ear protection. Further, what is disclosed herein is applicable to wearable audio devices that are wirelessly connected to other devices, that are connected to other devices through electrically and/or optically conductive cabling, or that are not connected to any other device, at all.

It should be noted that although specific implementations of wearable audio devices are presented with some degree of detail, such presentations of specific implementations are intended to facilitate understanding through provision of examples and should not be taken as limiting either the scope of disclosure or the scope of claim coverage.

FIG. 1 is a block diagram of an example of an in-ear wearable audio device 10 having two earpieces 12A and 12B, each configured to direct sound towards an ear of a user. (Reference numbers appended with an "A" or a "B" indicate a correspondence of the identified feature with a particular one of the two earpieces. The letter indicators are however omitted from the following discussion for simplicity, e.g., earpiece 12 refers to either or both earpiece 12A and earpiece 12B.) Each earpiece 12 includes a casing 14 that defines a cavity 16 that contains an electroacoustic transducer 28 for outputting audio signals to the user. In addition, at least one inner microphone 18 is also disposed within cavity 16. In implementations where wearable audio device 10 is ear-mountable, an ear coupling 20 (e.g., an ear tip or ear cushion) attached to the casing 14 surrounds an opening to the cavity 16. A passage 22 is formed through the ear coupling 20 and communicates with the opening to the cavity 16. In various implementations, one or more outer microphones 24 are disposed on the casing in a manner that permits acoustic coupling to the environment external to the casing 12.

Audio output by the transducer 28 and speech capture by the microphones 18, 24 within each earpiece is controlled by an audio processing system 30. Audio processing system 30 may be integrated into one or both earpieces 12, or be implemented by an external system. In the case where audio processing system 30 is implemented by an external system, each earpiece 12 may be coupled to the audio processing system 30 either in a wired or wireless configuration. In various implementations, audio processing system 30 may include hardware, firmware and/or software to provide various features to support operations of the wearable audio device 10, including, e.g., providing a power source, amplification, input/output, network interfacing, user control functions, active noise reduction (ANR), signal processing, data storage, data processing, voice detection, etc.

Audio processing system 30 can also include a sensor system for detecting one or more conditions of the environment proximate personal audio device 10. Such a sensor system, e.g., ensures that adapting the system is minimized in case the main VAD system has false negatives (e.g., the user is not talking loud enough, etc.). A sensor system by itself may not be reliable for VAD, but if the sensor system outputs activity that might indicate suspicion of voice activity along with a lower threshold VAD activity, adapting to minimize coefficient corruption can be avoided.

In implementations that include ANR for enhancing audio signals, the inner microphone 18 may serve as a feedback microphone and the outer microphones 24 may serve as feedforward microphones. In such implementations, each earphone 12 may utilize an ANR circuit that is in communication with the inner and outer microphones 18 and 24. The ANR circuit receives an internal signal generated by the inner microphone 18 and an external signal generated by the outer microphones 24 and performs an ANR process for the corresponding earpiece 12. The process includes providing a signal to an electroacoustic transducer (e.g., speaker) 28 disposed in the cavity 16 to generate an anti-noise acoustic signal that reduces or substantially prevents sound from one or more acoustic noise sources that are external to the earphone 12 from being heard by the user.

As noted, in addition to outputting audio signals, wearable audio device 10 is configured to provide two-way communications in which the user's voice or speech is captured and then outputted to an external node via the audio processing system 20. Various challenges may exist when attempting to capture the user's voice in an arrangement such as that shown in FIG. 1. For instance, the external microphones 24 are susceptible to picking up environmental noise, e.g., wind, which interferes with the user's speech. While the inner microphone 18 is not subject to environmental interference, speech coupled to the inner microphone 18 is primarily via bone conduction due to occlusion. As such, the naturalness of the voice picked up by the inner microphone is compromised and the useable bandwidth is approximately no more than 2 Khz. To address these shortcomings, as well as others, audio processing system 30 incorporates an internal signal processing system 40. In further implementations, audio processing system 30 includes a hybrid microphone processing system 100 that incorporates features of the internal signal processing system 40.

Figure 2:
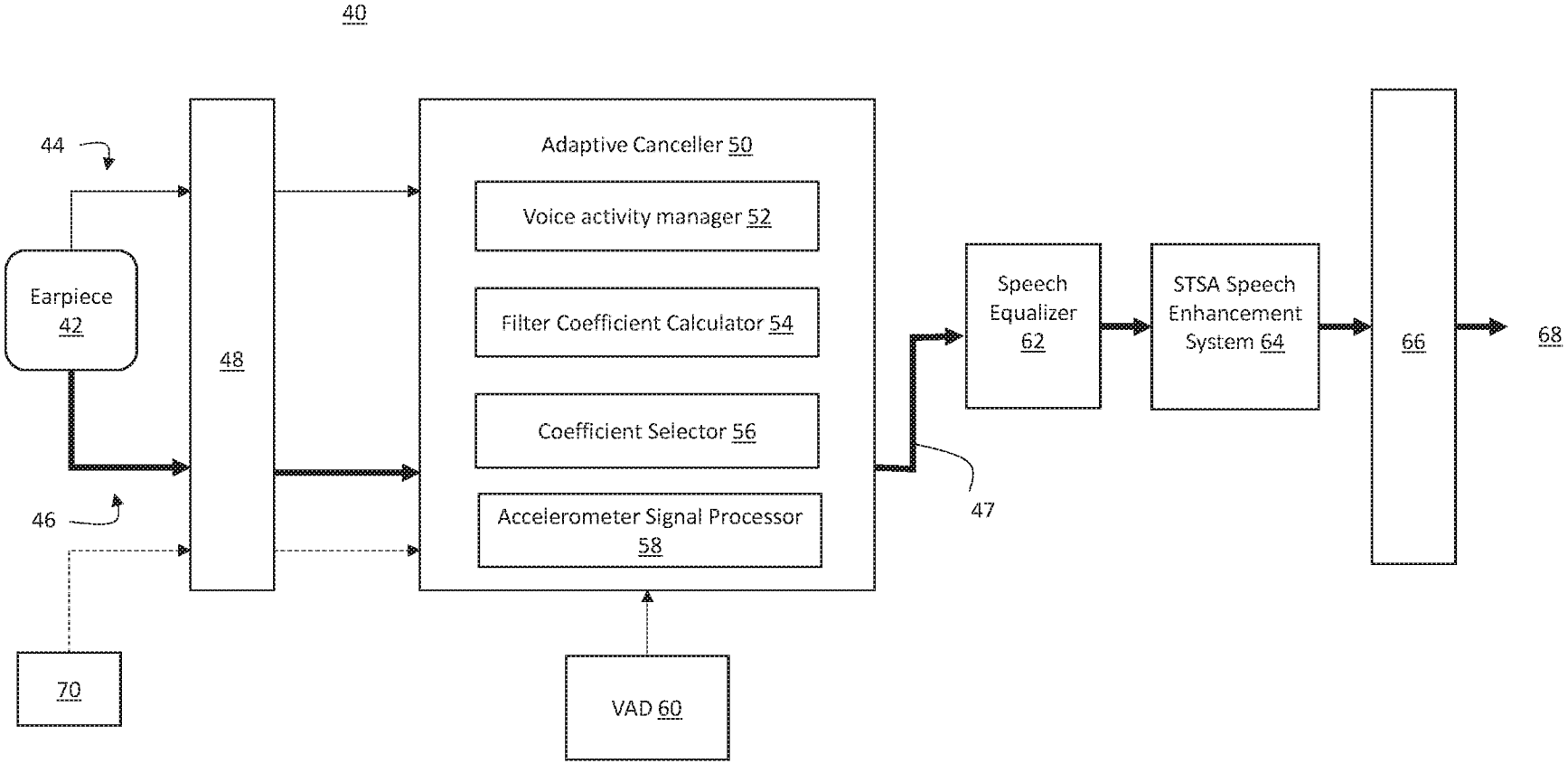
FIG. 2 is a block diagram depicting an inner microphone signal processing system according to various implementations.

FIG. 2 depicts an illustrative embodiment of an internal signal processing system 40, that generally includes: an earpiece 42 configured to capture at least one external signal 44 from an external microphone and at least one internal signal 46 from an inner microphone; a domain converter 48 that converts signals 44, 46 from the time (i.e., acoustic) domain to the frequency (i.e., electrical) domain; a voice activity detector (VAD) 60 that detects voice activity of the user; an adaptive canceller 50 that generates a noise reduced internal signal 47; and an inverse domain converter 68 that generates a time domain output signal 68. Domain converter 48 may for example be configured to convert the time domain signal into 64 or 128 frequency bands using a four channel weighted overlap add (WOLA) analysis, and inverse domain converter 68 may be configured to perform the opposite function. In some implementations, additional output stage processing features may include a speech equalizer 62 and a short-time spectral amplitude (STSA) speech enhancement system 64 to further enhance the noise reduced internal signal 47.

The adaptive canceller 50 calculates noise reduction parameters (e.g., filter coefficients) based on the external signal 44, and applies the parameters to the internal signal 46 to generate the noise reduced internal signal 47. In certain embodiments, adaptive canceller 50 includes a voice activity manager 52 that identifies when a non-voice activity period occurs based on inputs from VAD 60. During the period when no voice signal is detected, filter coefficient calculator 54 analyzes the external signal 44 to adaptively determine filter coefficients that will cancel any external acoustic noise from the internal signal 46. The filter coefficients can be calculated adaptively using any well-known adaptive algorithms such the normalized least means square (NLMS) algorithm. The coefficients represent the feedforward path between the external microphone and the internal microphone. In some cases adaptive canceller 50 can be preloaded with predetermined coefficients and adapt to changes to enable faster adaptation.

Whenever the non-voice period ends, i.e., when VAD 60 identifies speech activity of the user, coefficient selector 56 selects (i.e., freezes) the currently calculated coefficients, which are then applied to the internal signal 46 to eliminate external noise. When the user is no longer speaking and a new non-voice period begins, as indicated by VAD 60, adaptive canceller 50 discards the current set of noise cancellation filter coefficients and begins again to continuously calculate new sets of noise cancellation filter coefficients in response to the external signal 44.

In some implementations, adaptive canceller 50 utilizes an adaptive feedforward like noise canceller similar in principal to how a feedforward ANR system functions. In one implementation, the canceller 50 operates in the frequency (i.e., electrical) domain and hence can in-situ (accounting for fit variations) cancel noise to very low levels relative to what would be possible with a traditional ANR time (i.e., acoustic) domain feedforward system, which is instead based on pre-tuned coefficients. Operating in the electrical domain, the canceller 50 is not bounded by processing latencies to create a causal system. However, in an alternative approach, the canceller 50 could operate in the time domain to, e.g., minimize system complexity. Canceller 50 requires only a single external signal 44 and single internal signal 46, and does necessarily require any ANR system to be present.

With coefficients being determined in-situ during non-voice periods, the noise reduced internal signal 47 will have a high SNR due to an occlusion boost of the voice signal in the ear canal (typically below 1500 Hz), passive noise attenuation provided by the ear cup/bud which increases with frequency, and the continual cancellation of remaining external noise by the currently frozen coefficients. With this approach, voice energies up to three kilohertz (kHz) can be extracted, which then can be equalized with an appropriately designed speech equalizer 62 to provide an intelligible high SNR signal with acceptable voice quality to the far end.

In certain implementations, further bandwidth extension is possible by providing an accelerometer signal processor 58 that processes signals from a high frequency sensitive voice accelerometer 70, which can pick-up voice energy via bone vibration coupling with minimal sensitivity to environmental acoustic noise. Accelerator signal processor 58 may for example achieve this using short time spectral amplitude (STSA) estimation.

Some low-level acoustic noise can be cleaned up on the accelerometer signal with the STSA speech enhancement system 64 using an STSA estimation technique such as spectral subtraction, which is then appropriately combined with the noise reduced internal signal 47 to provide a rich higher bandwidth output signal 68.

The internal signal processing system 40 does not require any external microphone arrays, e.g., using Minimum Variance Distortionless Response (MVDR) beamforming, to operate. Depending on the system's requirements, this not only enables the potential for an inner microphone system to operate with just the two microphones (providing cost savings and eliminating any special factory calibration process), but allows the internal signal 46 to be relied upon in windy situations where traditional microphone arrays fail. Furthermore, the inner microphone is naturally shielded from the wind, so this enables the system to continue working in high noise and wind conditions than what is possible with traditional array based microphone systems, thus potentially solving a common complaint by headset users.

While the internal signal processing system 40 can provide very high SNR in high noise and wind environments relative to what an external microphone based system can do in similar conditions, the tradeoff is that some voice naturalness can be lost using the internal signal processing system 40 alone. The inner microphone voice quality can for example be compromised due to time varying multipath transmission paths, reverberant inner ear canal chamber, and poor high frequency voice pickup. In some implementations where a high voice quality is desired while maintaining intelligibility, a hybrid system is provided, such as that shown in FIG. 3.

Figure 3:
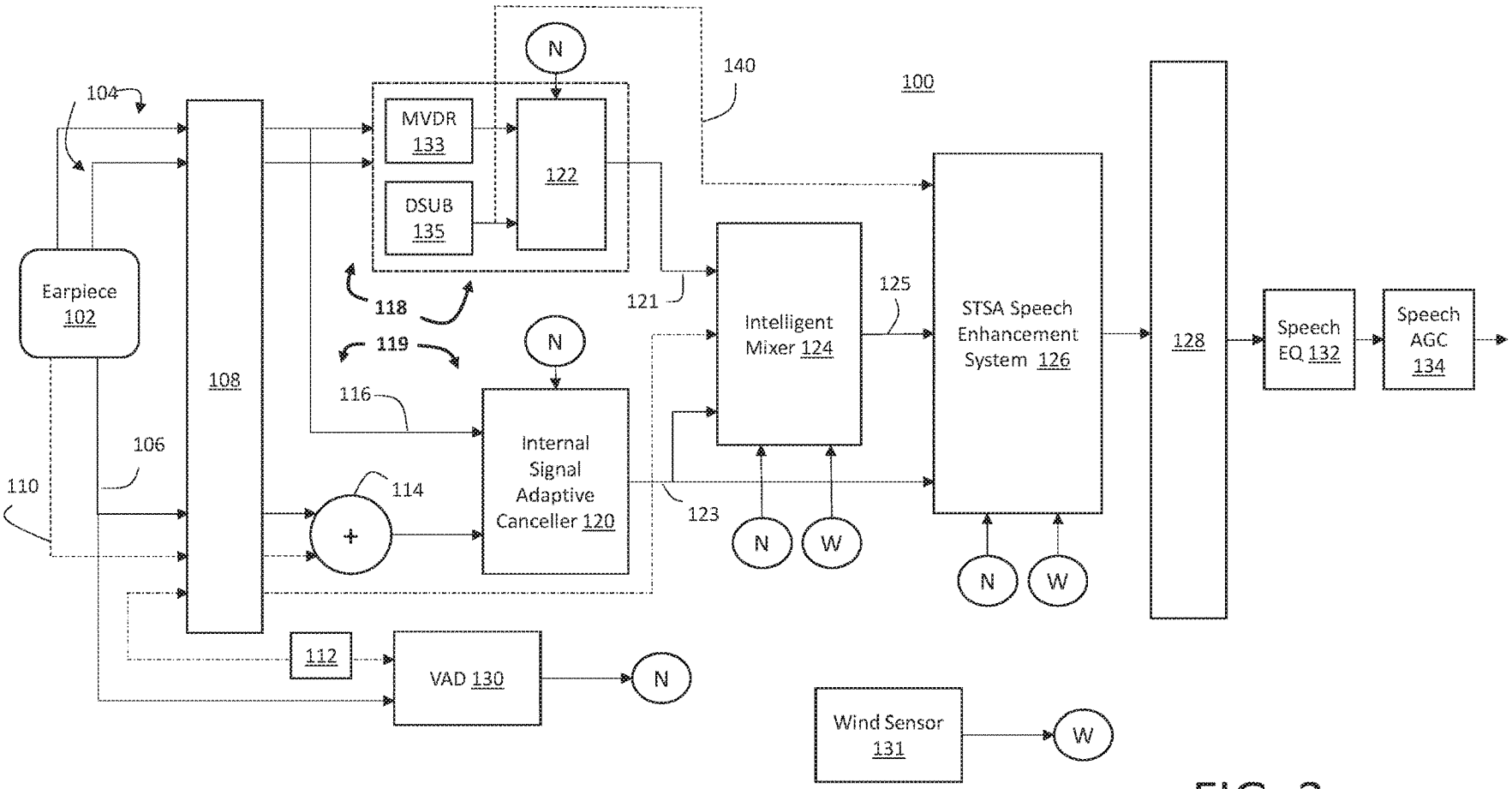
FIG. 3 is a block diagram depicting of a hybrid microphone processing system according to various additional implementations.

FIG. 3 depicts an illustrative hybrid microphone processing system 100 that includes an external processing system 118 that processes (i.e., noise reduces) at least one external signal 104 and an inner processing system 119 that processes (i.e., noise reduces) at least one internal signal 106. In various implementations, inner processing system 119 incorporates certain features of the internal signal processing system 40, describe in FIG. 2.

In one implementation shown, a pair of external signals 104 from a pair of external microphones and at least one internal signals 106 from an inner microphone are captured from an earpiece 102 and converted from a time domain to a frequency domain by domain converter 108. The external signals 104 are then processed by external processing system 118. The internal signal 106 is processed by internal processing system 119, based in part on at least one of the external signals 116. An intelligent mixer 124 mixes the output 121 of the external processing system 118 and the output 123 of the inner processing system 119 and generates a mixed signal 125. Depending on whether the user is speaking and the amount of external noise detected, the mixed signal 125 can include just one, or some of each, output 121, 123.

In certain implementations, the mixed signal 125 is passed to STSA speech enhancement system 126 to further reduce noise and extend the bandwidth of the mixed signal 125. STSA speech enhancement system 126 receives a noise reference signal 140 from the external processing system 118 and a reference speech signal (i.e., output 123) from the inner processing system 119. The resulting signal is the converted back to the time domain by inverse domain converter system 128, and processed by a speech equalizer (EQ) 132 and speech automatic gain control (AGC) 68. In certain implementations, speech equalizer 132 may include an input from mixer 124 indicating the amount of each signal 121, 123 that was used by the mixer 124. Based on the amounts, equalization can be set appropriately. In an alternative implementation, two separate speech equalizers may be utilized to process the signals 121, 123 before they are inputted into the mixer 124, rather than after as shown in FIG. 3. As noted, the inner microphone low frequency parts of the speech are boosted above a natural level due to occlusion and the high frequency is picked up less. An EQ on signal 123 may be configured to emphasize speech sounds that can contribute most to intelligibility and at same time maintain speech naturalness. An EQ on signal 121 would perform a similar operation but the curve defining the equalization might be a different shape.

Similar to the implementation shown in FIG. 2, internal processing system 119 includes a VAD 130 that generates a voice detection flag N, which is provided to the internal signal adaptive canceller 120 to facilitate adaptation of the filter coefficients during non-voice periods. Adapting during non-voice periods ensures that the filter coefficients will only focus on cancelling the noise transmission path to the inner microphone.

In one implementation, adaptive canceller 120 inputs the external signal 116, continuously calculates a set of noise cancellation parameters (i.e., filter coefficients) during non-voice periods in response to the external signal 116, establishes (i.e., freezes) a current set of noise cancelation parameters in response to a detection of speech by the user via VAD 130, and utilizes the current set of noise cancellation parameters to process the internal signal 106. In response to a determination that the user is no longer speaking, adaptive canceller 120 repeats the process of continuously calculating the set of noise cancellation parameters in response to the external signal until voice is detected again.

In some implementations, an optional accelerometer 112 that operates in a manner similar to that described with reference to FIG. 2 is provided, which can be utilized by both the VAD 130 to enhance voice detection and the mixer 124 to further enhance the mixed signal 125. In other implementations, an optional driver signal 110 that contains noise information can also be collected from the earpiece 102 and combined with the internal signal 106 by a combiner 114 to enhance the internal signal 106. Also shown is a wind sensor 131 that generates a wind signal W when high winds are detected. Both signals N and W are provided to the intelligent mixer 124 and STSA speech enhancement system 126, and the VAD signal N is further provided to the external processing system 118. Other types of sensors that detect environment noise other than wind could likewise be utilized.

In some implementations, processing of the external microphone signals 104 by external processing system 118 may include a single sided microphone-based noise reduction system that includes a minimum variance distortionless response (MVDR) beamformer 133, a delay and subtract process (DSUB) 135, and an external signal adaptive canceller 122. In one approach, DSUB 135 time aligns and equalizes the two microphone to mouth direction signals and subtracts to provide a noise correlated reference signal. Other complex array techniques could alternatively be used to minimize speech pickup in the mouth direction.

As noted, outputs 121, 123 from the external processing system 118 and the inner processing system 119, along with any accelerometer 112 output is fed into the intelligent mixer 124, which determines the optimal mix to send to the output stages. In certain implementations, at low levels of external noise (e.g., as determined by the wind sensor 131), the intelligent mixer 124 will favor output 121 from the external processing system 118 due to the inherent superior voice quality of the external microphones. At moderate levels of external noise, a mixture of the two outputs 121, 123 can be used. At very high noise levels (e.g., if wind is detected), the mixer 124 will switch to the internal processing system output 123 exclusively. In further implementations, other inputs, such as detection of head movements or mobility of the user can also be used to determine the best artifact free output. In still further implementations, mixer 124 can be controlled by the user via a user control input to manually select the best setting.

In various implementations, thresholds for selecting the best mix by the mixer 124 are based primarily on the SNR of each system 118, 119, and thresholds can be determined as part of a tuning process. In one implementation, the threshold can be tuned based on user preference. In other implementations, a manual switch can be provided to allow the user to force the inner microphone system to switch during high noise or wind. In certain implementations, to minimize artifacts, changes in the mixing ratio should only happen when near end speech is absent. The SNR can be accurately determined using VAD system 130, which is another benefit of using an inner microphone.

As shown, VAD 130 operates in the time domain, which provides a slight look ahead capability, but the system can be equally implemented in the frequency domain as well if desired. In some implementations, the internal signal 106 is bandpass filtered by the VAD 130 to where the voice signal has the highest SNR (typically from 400 Hz to 1600 Hz) squared to emphasize further high amplitude events (i.e., speech) versus low amplitude events (i.e., noise), appropriately processed with time constants to derive threshold-able metrics for very reliable voice activity detection. If accelerometer 112 is also present, the signal information from accelerometer 112 can also be utilized by the VAD 130 to enhance the accuracy and/or simplify the VAD 130 tuning. It is noted that such an enhanced VAD 130 benefits even a traditional external microphone based system, and hence can help to extend the operating range of the external microphone system. Detecting voice activity using only an external microphone can become unreliable under high noise or wind conditions, or if the noise source is in front of the user (i.e., same direction as the user speech).

An additional issue that may arise when using the inner microphone signal 106 is that during voice calls the inner microphone pickup will have a very high receive voice coupling due to proximity with the driver. Fortunately, this 'closeness' also means the driver to inner microphone transfer path is short and not expected to deviate much, resulting in a simple, low cost setup. In various implementations, an echo canceller with some amount of output signal attenuation can be used to provide an echo free output to the far end for full duplex communication. The driver to microphone signal transfer coefficients can be a pre-initialized measurement from ANR (e.g., using factory tuning or calculated in-situ), thus further simplifying the required adaptive filter design in adaptive canceller 120. In one approach, the average precomputed driver to inner microphone transfer function (e.g., a dummy ear or an average of several users) is measured and pre-initialize. Alternatively, the coefficients can be determined in-situ when wearer puts on the ear bud by playing a tune and measuring it.

Finally, if binaural signals are available, the overall system can be combined binaurally to provide an even more superior voice pickup system. For the inner microphone, two independent inner microphone voice pickups are utilized, and each may have some mutually exclusive information that can be combined to enhance the final output. Since the residual noise is likely to be uncorrelated between the two ears, the combination process can also further reduce noise. If audio signals cannot be communicated between the ears, then a control algorithm can determine which side has the best SNR for a given environment and use that side for communication.

Figure 4:
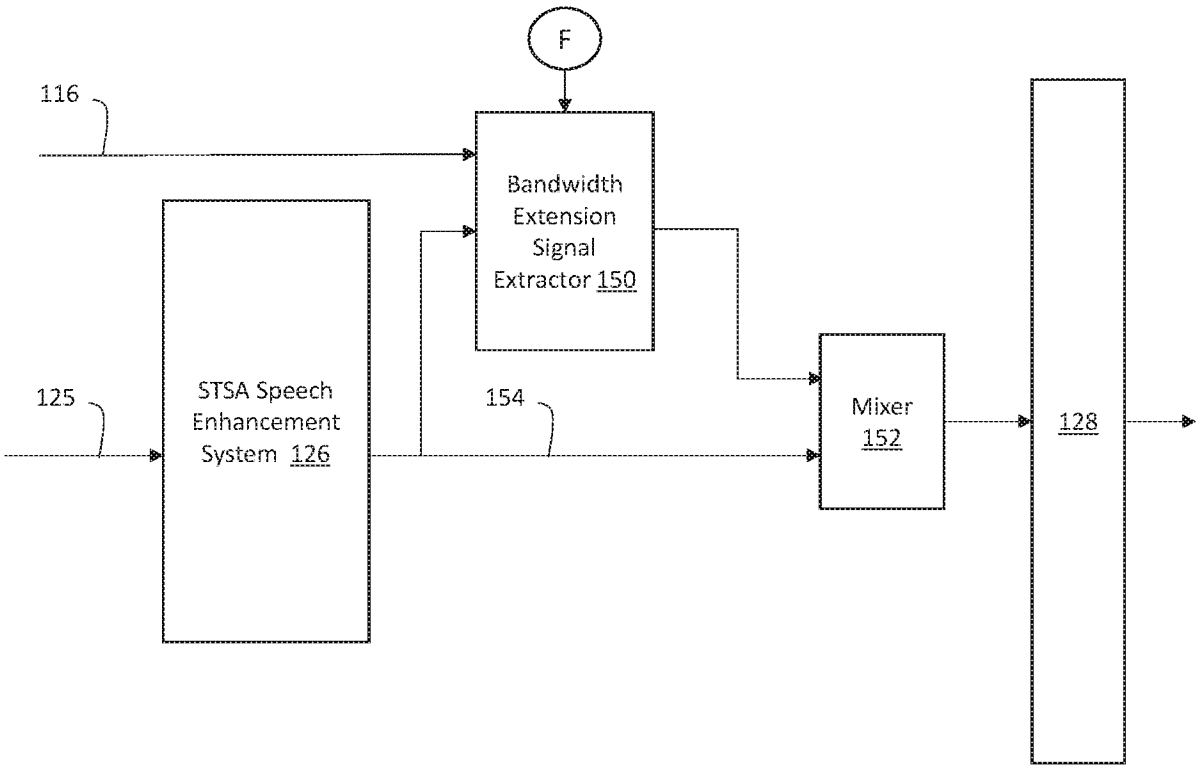
FIG. 4 is a block diagram of an additional aspect to the system of FIG. 3 that incorporates a bandwidth extension signal extractor according to various additional implementations.
Figure 5:
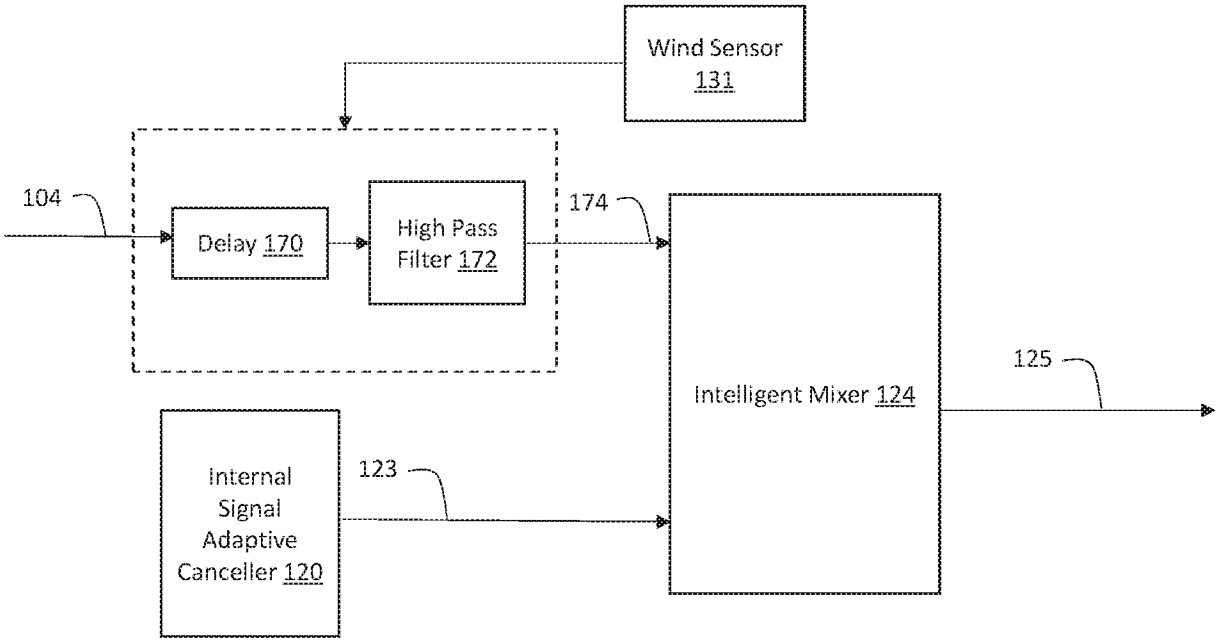
FIG. 5 is a block diagram of an additional aspect to the system of FIG. 3 that incorporates a high pass filter according to various additional implementations.
Figure 6:
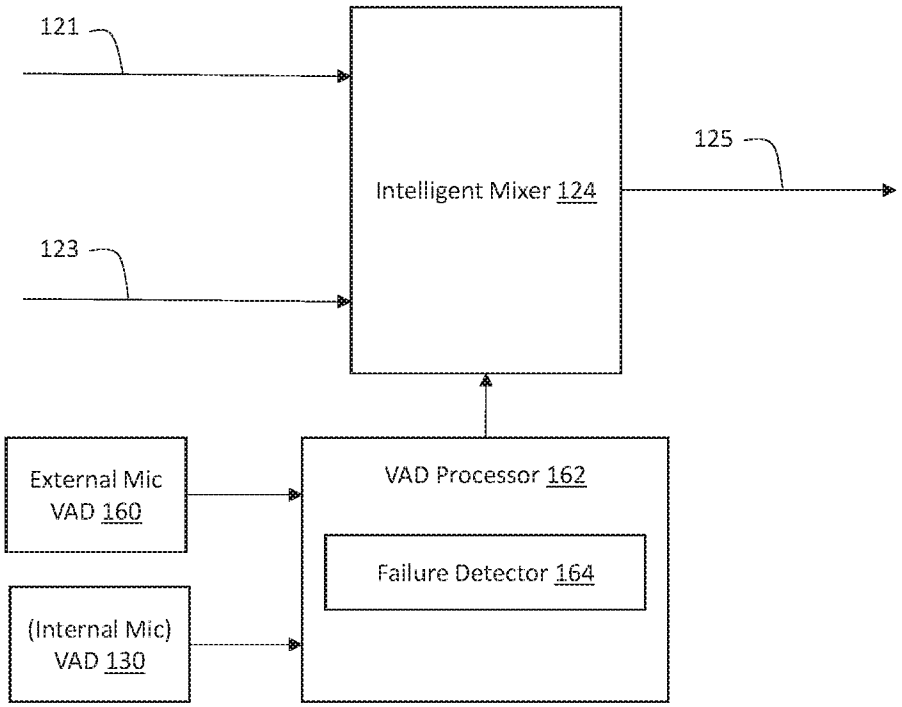
FIG. 6 is a block diagram of an additional aspect to the system of FIG. 3 that incorporates and external and internal VAD according to various additional implementations.

FIGS. 4-6 depict additional aspect that can be incorporated into the system 100 of FIG. 3. FIG. 4 depicts a first aspect for use when the user is speaking and only the noise reduced internal signal 123 is present in the output 125 of the intelligent mixer 124 (see FIG. 3), e.g., due extreme acoustic noise and wind conditions. In this case, the noise reduced external signal is unavailable due to the detected environmental noise. The internal noise reduced signal 123 provides reasonable sound quality up to about 2 kHz, but lacks higher frequency components, which results in a low quality sound for the listener. Under such conditions, a flag F is triggered and activates a bandwidth extension signal extractor 150, which processes the output 154 of the STSA speech enhancement system 126 to create high frequency components that are mixed with the output 154 to create a more pleasing sound quality. A signal 116 (see FIG. 3) obtained from the external microphone may also be utilized as reference signal by the bandwidth extension signal extractor 150 to help generate the high frequency components and maintain speech spectral balance to provide naturalness and intelligibility.

FIG. 5 depicts a second additional aspect for use when the user is speaking and there is low to moderate acoustic noise (e.g., caused by wind) that is interfering with the speech signal. In this case, e.g., when wind sensor 131 detects such conditions, the time domain signal 104 from one of the external microphones is processed with a delay 170 (to synch with the internal noise reduced signal 123) and a high pass filter 172 to extract high frequency components 174 from the external microphone signal 104. Wind noise generally comprises primarily low frequency components, so any existing high frequency components from the external microphone signal 104 can be captured for use. The resulting high frequency components 174 are fed to the intelligent mixer 124, along with the internal noise reduced signal 123, and mixed together to provide a robust signal 125 that includes both low and high frequency components.

FIG. 6 depicts a third additional aspect for improving voice activity detection. In this case, a VAD processor 162 is deployed that utilizes signals from both the internal microphone VAD 130 (described above) and an external microphone VAD 160. Whereas the internal microphone VAD 130 detects speech based on signals from the internal microphone, external microphone VAD 160 detects speech based on signals from the external microphone. While the internal microphone VAD 130 performs well under most conditions, certain conditions can result in errors in which speech is not detected (i.e., false negatives may occur). To address this, a failure detector 164 compares the two signals, which under ideal conditions, should have similar responses. In one approach, the internal microphone VAD 130 output is considered to be the "golden" reference. If the external microphone VAD 160 output deviates from the internal microphone VAD 130 signal beyond a predetermined threshold, it indicates that the conditions for using the external microphone are deteriorating and the VAD processor 162 can send a signal to the intelligent mixer 124 to use the internal microphone signal 123.

It is noted that the implementations described herein are particularly useful for two way communications such as phone calls, especially when using ear buds. However, the benefits extend beyond phone call applications in that these approaches can potentially provide SNR that rival boom microphones with just a single ear bud. These technologies are also applicable to aviation and military use where high nose pick up with ear buds is desired. Further potential uses include peer-to-peer applications where the voice pickup is shielded from echo issues normally present. Other use cases may involve automobile 'car wear' like applications, wake word or other human machine voice interfaces in environments where external microphones will not work reliably, self-voice recording/analysis applications that provide discreet environments without picking up external conversations, and any application in which multiple external microphones are not feasible. Further, the implementations may be useful in work from home or call center applications by avoiding picking up nearby conversations, thus providing privacy for the user.

It is understood that one or more of the functions of the described systems may be implemented as hardware and/or software, and the various components may include communications pathways that connect components by any conventional means (e.g., hard-wired and/or wireless connection). For example, one or more non-volatile devices (e.g., centralized or distributed devices such as flash memory device(s)) can store and/or execute programs, algorithms and/or parameters for one or more described devices. Additionally, the functionality described herein, or portions thereof, and its various modifications (hereinafter "the functions") can be implemented, at least in part, via a computer program product, e.g., a computer program tangibly embodied in an information carrier, such as one or more non-transitory machine-readable media, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions. All or part of the functions can be implemented as, special purpose logic circuitry, e.g., an FPGA (field programmable gate array) and/or an ASIC (application-specific integrated circuit). Processors suitable for the execution of a computer program include, by way of example, both general and special purpose microprocessors, and any one or more processors of any kind of digital computer. Generally, a processor may receive instructions and data from a read-only memory or a random access memory or both. Components of a computer include a processor for executing instructions and one or more memory devices for storing instructions and data.

It is noted that while the implementations described herein utilize microphone systems to collect input signals, it is understood that any type of sensor can be utilized separately or in addition to a microphone system to collect input signals, e.g., accelerometers, thermometers, optical sensors, cameras, etc.

Additionally, actions associated with implementing all or part of the functions described herein can be performed by one or more networked computing devices. Networked computing devices can be connected over a network, e.g., one or more wired and/or wireless networks such as a local area network (LAN), wide area network (WAN), personal area network (PAN), Internet-connected devices and/or networks and/or a cloud-based computing (e.g., cloud-based servers).

In various implementations, electronic components described as being "coupled" can be linked via conventional hard-wired and/or wireless means such that these electronic components can communicate data with one another. Additionally, sub-components within a given component can be considered to be linked via conventional pathways, which may not necessarily be illustrated.

A number of implementations have been described. Nevertheless, it will be understood that additional modifications may be made without departing from the scope of the inventive concepts described herein, and, accordingly, other implementations are within the scope of the following claims.

I claim:

1. A wearable two-way communication audio device, comprising:

an external microphone configured to be acoustically coupled to an environment outside an ear canal of a user;

an inner microphone configured to be acoustically coupled to an environment inside the ear canal of the user; and an adaptive noise cancelation system configured to, in response to a detected speech of the user, process an internal signal captured by the inner microphone and generate a noise reduced internal signal that includes the detected speech of the user, wherein the noise reduced internal signal is adaptively generated in response to an external signal captured by the external microphone.

2. The wearable audio device of claim 1, wherein the adaptive noise cancelation system utilizes at least one of: feedback-based active noise reduction (ANR) or feedforward-based ANR.

3. The wearable audio device of claim 1, wherein the adaptive noise cancellation system is configured to generate the noise reduced internal signal by:

inputting the external signal;

adaptively recalculating a set of noise cancellation parameters in response to the external signal;

establishing a current set of noise cancelation parameters in response to the detected speech by the user; and utilizing the current set of noise cancellation parameters to process the internal signal.

4. The wearable audio device of claim 3, wherein the adaptive noise cancelation system is further configured to:

in response to a determination that the user is no longer speaking:

ceasing utilization of the current set of noise cancellation parameters to process the internal signal; and adaptively recalculating the set of noise cancellation parameters in response to the external signal.

5. The wearable audio device of claim 3, wherein the detected speech is detected with a voice activity detector (VAD).

6. The wearable audio device of claim 3, further comprising an accelerometer that generates an accelerometer signal, wherein the adaptive noise cancelation system is configured to mix the accelerometer signal with the noise reduced internal signal to enhance frequency responses above approximately 2.5 kilohertz (kHz) to approximately 3.0 kHz.

7. The wearable audio device of claim 3, wherein the set of noise cancellation parameters comprise a set of filter coefficients.

8. The wearable audio device of claim 1, further comprising:

a second adaptive noise cancelation system configured to generate a noise reduced external signal by reducing noise in the external signal; and a mixer that selectively mixes the noise reduced external signal with the noise reduced internal signal to generate a mixed signal.

9. The wearable audio device of claim 8, wherein the mixer comprises:

a voice activity detector (VAD) input that signals the user is speaking; and a noise detection input that signals a presence of environmental noise.

10. The wearable audio device of claim 9, wherein the mixed signal primarily includes the noise reduced internal signal in response to detected speech of the user and environmental noise is present.

11. The wearable audio device of claim 9, wherein the mixed signal primarily includes the noise reduced external signal in response to a detection that no environmental noise is present.

12. The wearable audio device of claim 9, wherein the accelerometer signal is further utilized by the VAD to detect whether the user is speaking.

13. The wearable audio device of claim 9, wherein the internal signal and external signal are processed according to a method that comprises:

outputting an audio signal based on the noise reduced external signal in response to no detection of speech by the user;

adaptively recalculating a set of noise cancellation parameters based on the external signal;

establishing a current set of noise cancellation parameters in response to detection of speech by the user;

utilizing the current set of noise cancellation parameters to process the internal signal to generate the noise reduced internal signal;

supplying the noise reduced external signal and the noise reduced internal signal to the mixer;

mixing the noise reduced external signal and the noise reduced internal signal, wherein the mixing is based on an amount of environmental noise detected; and outputting the audio signal based on the mixed signal.

14. The wearable audio device of claim 9, wherein the VAD compares a first output from an internal microphone VAD with a second output from an external microphone VAD to detect a failure condition.

15. The wearable audio device of claim 14, wherein the failure condition is present if the second output deviates from the first output above a predetermined threshold.

16. The wearable audio device of claim 8, further comprising an accelerometer that generates an accelerometer signal to the mixer, wherein the accelerometer signal is selectively mixed with the noise reduced internal signal to provide an enhanced response for frequencies above approximately 2.5 kilohertz (kHz) to approximately 3.0 kHz.

17. The wearable audio device of claim 8, wherein the mixed signal is further processed using a short time spectral amplitude process.

18. The wearable audio device of claim 8, further comprising an equalizer that processes the mixed signal based on equalizer settings that are determined in response to an amount of the noise reduced external signal and an amount of the noise reduced internal signal present in the mixed signal.

19. The wearable audio device of claim 8, further comprising:

a first equalizer configured to process the noise reduced external signal prior to input to the mixer; and a second equalizer configured to process the noise reduced internal signal prior to input to the mixer.

20. The wearable audio device of claim 8, wherein the method further comprises:

in response to a determination that the user is no longer speaking:

ceasing utilization of the current set of noise cancellation parameters to process the internal signal;

adaptively recalculating the set of noise cancellation parameters based on the external signal; and outputting the audio signal based on the noise reduced external signal.

21. The wearable audio device of claim 8, wherein, in response to detection of speech by the user and the noise reduced external signal is unavailable due to a predetermined amount of environmental noise:

processing the noise reduced internal signal with a bandwidth extension signal extractor to generate high frequency components; and mixing the high frequency components with the noise reduced internal signal.

22. The wearable audio device of claim 21, wherein the noise reduced internal signal is first processed with a speech enhancement system.

23. The wearable audio device of claim 1, wherein, in response to detection that the user is speaking and a predetermined amount of environmental noise is detected:

processing an external microphone signal with a high pass filter to obtain high frequency components; and mixing the high frequency components with the noise reduced internal signal to generate the mixed signal.

24. A method for processing signals associated with a wearable audio device, comprising:

capturing an external signal with an external microphone configured to be acoustically coupled to an environment outside an ear canal of a user;

capturing an internal signal with an inner microphone configured to be acoustically coupled to an environment inside the ear canal of the user;

in response to a detected speech of the user, processing the internal signal captured by the inner microphone to generate a noise reduced internal signal that includes the detected speech, wherein the noise reduced internal signal is adaptively generated in response to the external signal captured by the external microphone; and outputting a signal that includes the noise reduced internal signal to an external node of a two-way communication system.

25. The method of claim 24, wherein processing the internal signal comprises:

continuously calculating a set of noise cancellation parameters based on the external signal;

establishing a current set of noise cancelation parameters in response to detection of speech by the user;

utilizing the current set of noise cancellation parameters to process the internal signal; and in response to a determination that the user is no longer speaking:

ceasing utilization of the current set of noise cancellation parameters to process the internal signal; and continuously calculating the set of noise cancellation parameters in response to the external signal.

* * * * *